US011096267B2

(12) United States Patent
Fandrich et al.

(10) Patent No.: US 11,096,267 B2
(45) Date of Patent: Aug. 17, 2021

(54) ELECTRIC DISCHARGE DEVICE AND METHOD FOR TREATMENT OF FLUIDS

(71) Applicant: Pure Bio Synergy Sweden AB, Ankarsrum (SE)

(72) Inventors: Manfred Karl Fandrich, Nafai-Chaiyaphum (TH); Tosawon Chaimongkonskoon, Bangkok (TH)

(73) Assignee: Pure Bio Synergy Sweden AB

( * ) Notice: Subject to any disclaimer, the term of this patent is extended or adjusted under 35 U.S.C. 154(b) by 30 days.

(21) Appl. No.: 16/469,199

(22) PCT Filed: Dec. 28, 2017

(86) PCT No.: PCT/SE2018/050008
§ 371 (c)(1),
(2) Date: Jun. 13, 2019

(87) PCT Pub. No.: WO2018/124964
PCT Pub. Date: Jul. 5, 2018

(65) Prior Publication Data

US 2019/0387604 A1 Dec. 19, 2019

(30) Foreign Application Priority Data

Dec. 29, 2016 (SE) ..... 1651752-6

(51) Int. Cl.
*H05H 1/24* (2006.01)

(52) U.S. Cl.
CPC ..... *H05H 1/2406* (2013.01); *H05H 2001/245* (2013.01); *H05H 2001/2412* (2013.01); *H05H 2001/2456* (2013.01)

(58) Field of Classification Search
CPC ..... H05H 1/2406; H05H 2001/2412; H05H 2001/245; H05H 2001/2456;
(Continued)

(56) References Cited

U.S. PATENT DOCUMENTS 5,516,493 A 5/1996 Bell et al.
2002/0153241 A1* 10/2002 Niv ..... H05H 1/2406 204/164
(Continued)

FOREIGN PATENT DOCUMENTS

CN 2126230 12/1992
CN 2589454 Y 12/2003
(Continued)

OTHER PUBLICATIONS

International Search Report and Written Opinion dated Apr. 13, 2018; International Patent Application No. PCT/SE2018/050008 filed Dec. 28, 2017.
(Continued)

*Primary Examiner* — Xiuyu Tai
(74) *Attorney, Agent, or Firm* — McDonald Hopkins LLC

(57) ABSTRACT

The present disclosure relates to an electric discharge device and associated method for molecular restructuring of a fluid. The electric discharge device comprises a discharge cell including a first dielectric layer and a second dielectric layer that are spaced apart by a gap constituting a flow channel for a feed fluid to be molecularly restructured. The dielectric layers and the flow channel are arranged between a first electrode and a second electrode for generating electric discharge in the flow channel when voltage is applied between the electrodes. The discharge cell comprises a double-walled dielectric tube having an inner wall and an outer wall that come together at both ends of the tube to form a double-walled dielectric tube made in one piece, the inner and outer walls of the double-walled dielectric tube constituting the first and second dielectric layers of the discharge cell.

20 Claims, 8 Drawing Sheets

(58) Field of Classification Search
CPC ..... H05H 2245/121; H05H 2001/481; B01J 19/08; B01J 19/088; B01J 2219/0875; B01J 2219/0809; B01J 2219/083; B01J 2219/0869; B01J 2219/0883; B01J 2219/0894; B01J 2219/0841; H01J 37/3255; H01J 37/32348; H01J 37/32532; H01J 37/32568; H01J 37/32541; B82Y 30/00; C01B 33/029
See application file for complete search history.

(56) References Cited

U.S. PATENT DOCUMENTS

| | | | | |
|---|---|---|---|---|
| 2005/0167260 | A1 | 8/2005 | Kong et al. | |
| 2008/0257258 | A1 | 10/2008 | Yajima et al. | |
| 2009/0014423 | A1* | 1/2009 | Li | B01J 19/088 219/121.47 |
| 2014/0079617 | A1 | 3/2014 | Grant | |
| 2014/0225498 | A1* | 8/2014 | Koo | H01J 37/3255 313/231.31 |

FOREIGN PATENT DOCUMENTS

| | | | |
|---|---|---|---|
| CN | 2666885 | Y | 12/2004 |
| CN | 1781841 | A | 6/2006 |
| CN | 2878349 | Y | 3/2007 |
| CN | 102595757 | | 7/2012 |
| CN | 103179772 | | 6/2013 |
| DE | 19518970 | C1 | 11/1996 |

OTHER PUBLICATIONS

Office Action dated Jun. 26, 2017; Swedish Patent Application No. 1651752-6.
Search Report dated Jun. 26, 2017; Swedish Patent Application No. 1651752-6.
Office Action dated Nov. 26, 2019; Chinese Patent Application No. 201780081861.9.

* cited by examiner

ELECTRIC DISCHARGE DEVICE AND METHOD FOR TREATMENT OF FLUIDS

CROSS-REFERENCE TO RELATED APPLICATION

This application is a 35 U.S.C. § 371 national stage application of PCT Application No. PCT/SE2018/050008 filed on Dec. 28, 2017, entitled "ELECTRIC DISCHARGE DEVICE AND METHOD FOR TREATMENT OF FLUIDS," which claims priority to Swedish Patent Application No. 1651752-6 filed on Dec. 29, 2016, each of which are incorporated herein in their entirety by reference.

TECHNICAL FIELD

The present invention relates to a device and method for molecular restructuring of fluids using the well-known principle of corona discharge.

BACKGROUND

A corona discharge is an electric discharge brought on by the ionization of a fluid surrounding a conductor that is electrically charged. Devices that utilize the principle of corona discharge for molecular restructuring of gases are well-known in the art and primarily used for ozone generation.

Known corona discharge devices for ozone production comprises a discharge cell, sometimes referred to as plasma cell, comprising two electrodes between which a high voltage is applied to create electric discharge. At least one dielectric layer, usually a layer of glass, is arranged between the electrodes to diffuse the electric discharge over an area of the discharge cell so as to create a corona discharge. Oxygen-containing gas is fed through the discharge field, sometimes referred to as plasma field, to convert the oxygen to ozone through molecular restructuring of oxygen molecules ($2O_2 \rightarrow O_3 + O$).

Typically, the discharge cell of a corona discharge device has the shape of a cylindrical tube. For example, WO93/16001 discloses a cylindrical discharge cell having an inside electrode surrounded by a cylindrical dielectric tube and an outside electrode.

One challenge associated with known corona discharge devices is that moisture in the gas to be molecularly restructured (feed gas) deteriorates the performance and decreases the lifetime of the device. Another challenge is the difficulty of providing efficient cooling of the electrodes and the other components of the discharge cell during use of the corona discharge device. These challenges make most commercially available corona discharge devices unsuitable for use in warm and high-humidity ambient conditions, e.g. in tropical climates.

To prevent that moisture in the feed gas corrodes the electrodes and adversely affects the performance and lifetime of the discharge cell, it has been suggested to separate the feed gas from the electrodes by means of two spaced-apart dielectric layers defining a gas flow channel for the feed fluid, interposed between the electrodes.

For example, U.S. Pat. No. 5,516,493 discloses a discharge cell for ozone generation wherein a first and inner glass tube is concentrically arranged inside an outer glass tube, so as to form a gas flow channel for the feed gas in the annular channel formed between the inner and outer glass cylinder. A first electrode is arranged inside the inner glass tube and a second electrode is arranged outside the outer glass tube to create a plasma field in the gas flow channel. The inner and outer glass tubes are supported and spaced apart by spacer means in form of UV and ozone resistant PVC end caps, attached by means of sealant to the inner and outer glass tubes in opposite ends of the discharge cell. The corona discharge device further includes feed gas supply means comprising, e.g., an air compressor or bottled oxygen, an air cooler and an air dryer. CN 2666885 Y also discloses a background art discharge device, and more specifically a background art double-walled dielectric tube with end caps.

One problem associated with this and similar corona discharge devices is the complexity and sensitivity of the system and the need for compressors, coolers and dryers. Another problem is the cumbersome assembling of the various parts constituting the discharge cell. Yet another problem is the risk of the end-caps and the sealant failing to prevent moisture or dust in the pressurized feed gas from leaking into areas housing the electrodes.

Consequently, there is a desire to provide a corona discharge device that eliminates or at least deviates some or all of the above mentioned problems.

Corona discharge devices may also be used for removal of unwanted particles from air in air-conditioning systems, and for removal of unwanted volatile organics, such as chemical pesticides, solvents, or chemical weapons agents, from the atmosphere. Also, US2003/0180199 suggests a corona discharge device (plasma reactor) be used for emission control in a vehicle for reducing noxious gas contained in the exhaust gas of the vehicle.

However, different fields of application put different demands on the corona discharge device and, therefore, it is a further desire to provide a more versatile device than corona discharge devices according to prior art, which can be used in different fields of application.

SUMMARY

It is an object of the present invention to solve or at least mitigate some of the above mentioned problems associated with the prior art.

In particular, it is an object of the present invention to provide an electric discharge device for molecular restructuring of fluids that is less complex compared to the prior art in terms of number of parts of the discharge cell.

Another object of the present invention is to provide an electric discharge device for molecular restructuring of fluids that allows efficient cooling of the device during use.

Another object of the present invention is to provide an electric discharge device for molecular restructuring of fluids that is insensitive to moisture in the feed fluid to be restructured.

Yet another object of the present invention is to provide a versatile electric discharge device that can be used for molecular restructuring of different fluids and/or in different fields of applications with a minimum of adjustment of the electric discharge device.

These and other objects which will become apparent from the detailed description following hereinafter are achieved by an electric discharge device and a method for molecular restructuring of fluids, as set forth in the appended claims.

The electric discharge device of the present disclosure comprises a discharge cell having a first and a second dielectric layer, spaced apart by a gap constituting a flow channel for a feed fluid to be molecularly restructured. The dielectric layers and the flow channel are arranged between a first and a second electrode for generating electric discharge, normally referred to as corona discharge, through the flow channel when a high voltage is applied between the electrodes. The dielectric layers are arranged such that the fluid is never brought into contact with any of the electrodes of the discharge cell by physically separating the fluid from the electrodes.

Consequently, moisture and other corroding substances in the fluid are prevented from reacting with the material of the electrodes, thus increasing the lifetime of the electric discharge device. Also, by preventing moisture and dust in the feed fluid from reaching the electrodes, the risk of arcing and short-circuiting in the discharge cell is reduced.

The above mentioned effects make the electric discharge device particularly suitable for use in high-humidity and high-pollution environments.

According to one aspect of the present disclosure, the discharge cell comprises a single-piece, double-walled dielectric tube, i.e. a double-walled tubular component that is integrally formed in one piece from a dielectric material, preferably a single dielectric material, such as glass. The double-walled dielectric tube comprises a cylindrical inner wall formed by an inner dielectric tube and an outer wall formed by an outer dielectric tube. The inner and outer dielectric tubes come together at both ends of the tubes to form a double-wall structure that is closed or partly closed in both ends.

The inner and outer walls of the double-walled tube constitute the dielectric layers of the discharge cell, and the space that is formed between them constitute the flow channel for the fluid to be restructured. The first and second electrodes are arranged on opposite sides of the double-wall structure of the dielectric tube to generate electric discharge across the flow channel between the walls, meaning that the inner electrode is arranged inside of the inner wall of the double-walled dielectric tube, and the outer electrode is arranged outside the outer wall of the double-walled dielectric tube. The first and second electrodes thus constitute an inner and outer electrode of the discharge cell.

An advantage of providing the dielectric layers of the discharge cell in form of a double-walled, single-piece dielectric tube is that the complexity and the number of components of the discharge cell is reduced.

Another advantage is that the risk of corrosion, arcing and short-circuiting due to moisture and dust penetrating into areas housing the electrodes of the discharge cell is effectively reduced by the delimiting walls of the fluid flow channel being formed as an integral part.

Yet another advantage is the facilitation of improved cooling of the discharge cell. By forming the double-walled tube as an integral part formed in one piece by its inner and outer walls coming together in both ends, the inner and outer walls of the double-wall structure are in and by themselves supported and retained in a fixed spatial relation to each other. Thereby, the need for end-caps or other supporting and retaining means, required in the prior art, is eliminated. This in turn allows for a cooling medium, such as air, to flow through a through channel extending along the centre axis of the discharge cell, from one end of the discharge cell to the other, thereby effectively cooling the inner electrode of the discharge cell. Therefore, during use, the discharge cell is preferably mounted in the electric discharge device without the use of end-caps or any other components that prevent a flow of cooling medium from flowing freely through the through channel along the centre axis of the discharge cell.

Another advantage is the facilitation of easy mounting of the electrodes of the discharge cell. The inner electrode can be easily inserted through an open end of the double-walled dielectric tube, whereas the outer electrode of the discharge cell can be easily mounted exterior to the outer wall of the double-walled tube.

Preferably but not necessarily, the double-walled dielectric tube is a double-walled cylindrical tube having an inner wall forming an inner cylindrical tube of a first radius, an outer wall forming an outer cylindrical tube of a second and slightly larger radius, and side walls connecting the inner and outer cylinders at both ends so as to form the single-piece, double-walled dielectric tube. In this case, the inner electrode is preferably a cylindrical electrode having a radius that is slightly smaller than the inner cylindrical wall of the double-walled cylindrical tube, whereas the outer electrode may be a cylindrical electrode having a radius that is slightly bigger than the outer cylindrical wall of the double-walled cylindrical tube. In one exemplary embodiment, the inner and outer electrodes are formed by stainless steel foils that may be wrapped against the inner surface of the inner cylindrical wall and the outer surface of the outer cylindrical wall, respectively.

The double-walled dielectric tube comprises at least one inlet for receiving feed fluid into the space between the inner and outer walls constituting the flow channel, and at least one outlet for discharge of fluid that has been molecularly restructured upon passage through the discharge cell, hereinafter referred to as "cracked fluid". The first and second electrodes are disposed between the inlet and the outlet in the axial direction of the double-walled tube. When realized in form of a cylindrical double-walled dielectric tube, the flow channel within the double-wall structure constitutes an annular flow channel between the inlet and the outlet.

The inlet and outlet are typically arranged in or close to opposite ends of the double-walled dielectric tube. In one exemplary embodiment, at least one and preferably both of the inlet and outlet is formed on an envelope surface of the double-walled dielectric tube, i.e., formed in the outer wall of the double-walled dielectric tube. This is advantageous in that the inlet and outlet can be made big enough to allow big volumes of fluid to pass through the discharge cell per time unit. It is also advantageous in that it facilitates the connection of tubes for the feed fluid and the cracked fluid to the inlet and outlet of the double-walled dielectric tube.

In another exemplary embodiment, the at least one inlet and/or the at least one outlet is formed on a side wall of the double-wall structure of the dielectric tube, i.e. formed in a side wall connecting the inner wall and the outer wall of the double-wall structure with each other. For example, both of the inlet and the outlet can be formed by a plurality of apertures in a respective side wall of the double-wall structure.

Preferably, the double-walled dielectric tube is formed by a single dielectric material, such as glass, ceramic, quartz or mica. In one exemplary embodiment, the dielectric material is glass, such as borosilicate glass. The double-walled and integrally formed dielectric tube is preferably made in a single piece through a moulding process, such as mould-blowing process.

According to another aspect of the present disclosure there is provided a method for molecular restructuring of a fluid, comprising the steps of:

applying a voltage between a first and a second electrode of a discharge cell of an electric discharge device further comprising two dielectric layers arranged between the first and second electrodes, the first and second dielectric layers delimiting a flow channel for a fluid to be restructured and preventing the fluid from getting into fluid communication with the first and the second electrodes, and feeding a fluid to be restructured through the flow channel of the discharge cell.

In the discharge cell, the molecules of the feed fluid to be restructured are cracked to produce a resulting fluid that has a different molecular composition than the feed fluid. For efficient cracking, design parameters such as a driving frequency for a drive circuit of the electric discharge device and the dimensions and materials of the discharge cell should be carefully adapted to the fluid to be molecularly restructured.

As previously mentioned, the feed fluid to be molecularly restructured may be a gas, e.g. an oxygen-containing gas that is fed through the discharge cell to produce ozone. However, the electric discharge device of the present disclosure may be used also for molecular restructuring of fluids other than gases. In particular, the electric discharge device may be advantageously used also for molecular restructuring of liquids, e.g. for the purpose of purifying, refining and/or activating liquids.

For example, experiments have shown that the electric discharge device may be advantageously used in fuel refining processes. In particular it has been shown that the electric discharge device may be used to produce biodiesel from vegetable oils (bio-oils), such as jatropha oil, palm oil, or rape seed oil, by passing the vegetable oil through the discharge cell.

It has also been shown that the electric discharge device may be advantageously used to increase combustion efficiency in combustion engines of both biofuel-based vehicles and fossil fuel-based vehicles, in particular diesel driven vehicles, by having the fuel pass through the discharge cell prior to combustion by the combustion engine.

Consequently, according to another aspect of the present disclosure, there is provided a method for molecular restructuring of a liquid, comprising the steps of:

applying a voltage between a first and a second electrode of a discharge cell of an electric discharge device further comprising two dielectric layers arranged between the first and second electrodes, the first and second dielectric layers delimiting a flow channel for a fluid to be restructured and preventing the fluid from getting into fluid communication with the first and the second electrodes, and feeding a liquid to be restructured through the flow channel of the discharge cell.

As clear from above, the liquid may be a vegetable oil, such as jatropha oil, that is fed through the discharge cell to produce biodiesel in a process where electric discharge (corona discharge) in the fluid flow channel cracks the vegetable oil molecules into lighter and more valuable (from a combustion efficiency perspective) molecules. The liquid may also be a fuel, such as diesel, that is fed through the discharge cell of a vehicle-mounted electric discharge device to produce a more combustion-efficient fuel by cracking the molecules of the fuel prior to injection into a combustion engine of the vehicle.

Thus, according to another aspect of the present disclosure, there is provided a method for producing biodiesel from a vegetable oil (bio-oil), such as jatropha oil, comprising the steps of:

applying a voltage between a first and a second electrode of a discharge cell of an electric discharge device further comprising two dielectric layers arranged between the first and second electrodes, the first and second dielectric layers delimiting a flow channel for a fluid to be molecularly restructured and preventing the fluid from getting into fluid communication with the first and the second electrodes, and feeding a vegetable oil through the flow channel of the discharge cell to produce biodiesel.

According to yet another aspect of the present disclosure, there is provided a method for refinement of fuel prior to combustion of the fuel in a combustion engine of a vehicle, comprising the steps of:

applying a voltage between a first and a second electrode of a discharge cell of an electric discharge device arranged upstream of the combustion engine in a fuel flow channel of the vehicle, the discharge cell further comprising two dielectric layers arranged between the first and second electrodes and delimiting a flow channel for a fluid to be molecularly restructured, thereby preventing the fluid from getting into fluid communication with the first and the second electrodes;

feeding a feed fuel through the flow channel of the discharge cell;

cracking, in the discharge cell, the molecules of the feed fuel to produce a refined fuel having another molecular composition than the feed fuel, and feeding the refined fuel into the combustion engine.

Use of electric discharge devices in combustion engines in order to increase combustion efficiency and reduce fuel consumption and/or production of exhaust gases, such as NOx, has been proposed before in e.g. US2008/0257258 and JP62195449.

For example, in US2008/0257258, a corona-discharge ozone generator is disposed in an intake manifold for generating ozone that is used for activating the oxygen of the air-fuel mixture that is sucked into the intake manifold.

In JP62195449, an ionizing device is firmly adhered around an existing fuel hose to electrify the fuel by negative corona discharge. Another ionizing device for positive corona discharge is used to positively electrify the nitrogen and oxygen contained in the air that is to be mixed with the fuel. The positively charged gas molecules more efficiently react with the negatively charged fuel molecules, thereby increasing combustion efficiency. This is different from the proposed method of conducting the fuel through an electric discharge device that is configured for molecular restructuring of the fuel, i.e. to crack the molecules of the fuel into lighter and more combustion-efficient molecules.

According to another aspect of the present disclosure there is provided a method for treatment of wastewater, comprising the steps of:

applying a high voltage between a first and a second electrode of a discharge cell of an electric discharge device further comprising two dielectric layers arranged between the first and second electrodes, the first and second dielectric layers delimiting a flow channel for a fluid to be molecularly restructured and preventing the fluid from getting into fluid communication with the first and the second electrodes, and feeding a mixture of oxygen-containing gas and hydrogen peroxide through the discharge cell to produce a reactive mixture comprising ozone and hydroxyl radicals, and adding the reactive mixture to a volume of wastewater for wastewater purification.

The hydroxyl radicals of the reactive mixture are highly reactive and provide, in combination with the ozone, a detergent effect that is not accounted for by the ozone alone.

According to yet another aspect of the present disclosure there is provided a method for treatment of industrial process water, comprising the steps of:

collecting industrial process water;

applying a high voltage between a first and a second electrode of a discharge cell of an electric discharge device further comprising two dielectric layers arranged between the first and second electrodes, the first and second dielectric layers delimiting a flow channel for a fluid to be molecularly restructured and preventing the fluid from getting into fluid communication with the first and the second electrodes, and feeding the industrial process water through the discharge cell.

Subjecting the industrial process water to corona discharge has been found advantageous in that it eliminates impurities in the industrial process water and enhances subsequent precipitation of heavy metals.

All of the above mentioned methods for molecular restructuring of fluids may be advantageously performed using an electric discharge device equipped with a double-walled dielectric tube as described above, whereby the fluid, may it be liquid or gas, is fed through a flow channel that is delimited by the inner and outer walls of the double-walled dielectric tube.

More advantageous features of the electric discharge device and the methods for molecular restructuring of fluids will be described in the detailed description following hereinafter.

BRIEF DESCRIPTION OF DRAWINGS

A more complete appreciation of the invention disclosed herein will be obtained as the same becomes better understood by reference to the following detailed description when considered in conjunction with the accompanying drawings briefly described below, in which drawings the same reference numerals are used to represent corresponding functional elements.

DETAILED DESCRIPTION

Figure 1:
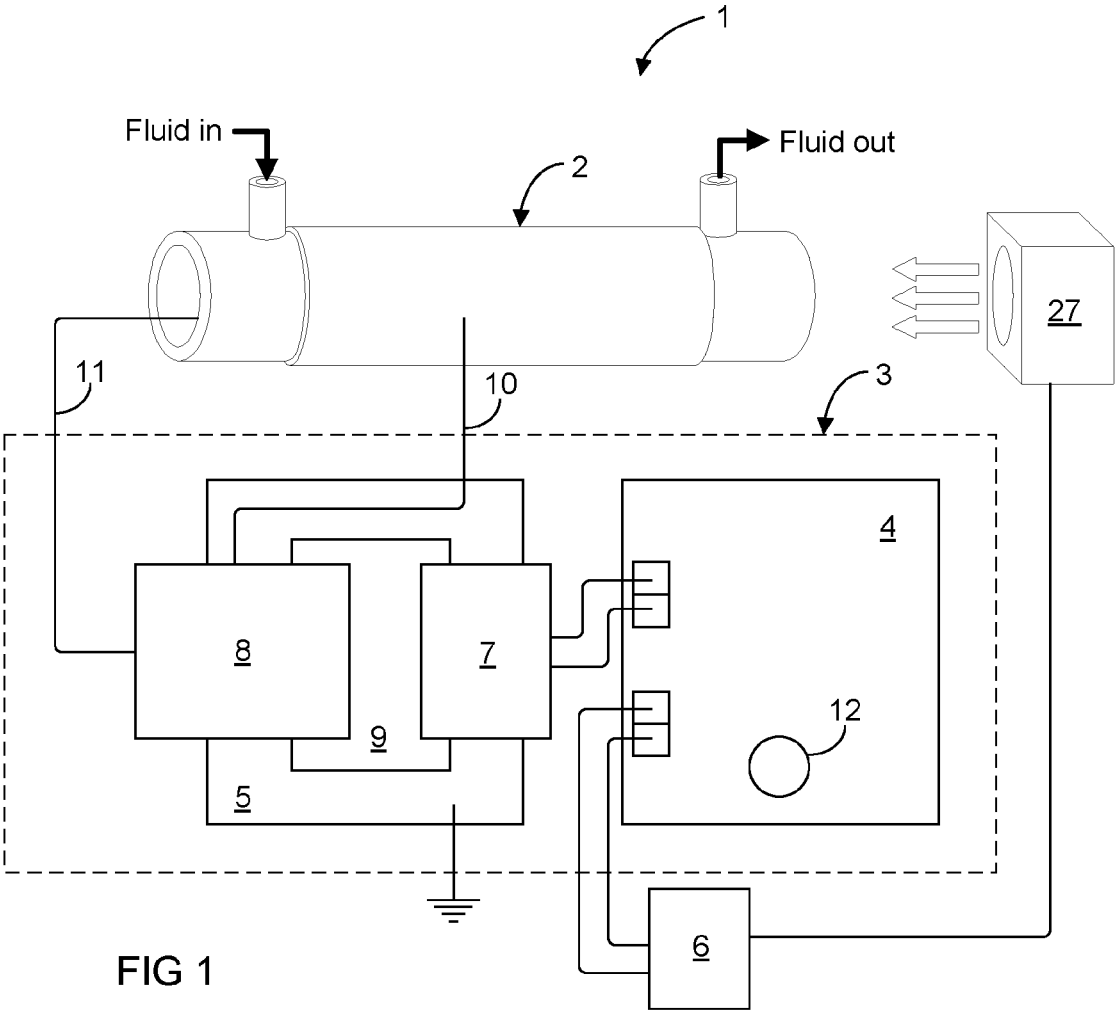
FIG. 1 illustrates an electric discharge device for molecular restructuring of a fluid, according to an exemplary embodiment of the present disclosure.

FIG. 1 illustrates an electric discharge device 1 for molecular restructuring of a fluid according to an exemplary embodiment of the present disclosure.

The electric discharge device 1 is a corona discharge device configured to crack the molecules of a fluid by subjecting the fluid to corona discharge. To this end, the electric discharge device 1 comprises a discharge cell 2 for corona discharge, and a drive circuit 3 for applying a high voltage between electrodes of the discharge cell in order to generate corona discharge.

The drive circuit 3 comprises a converter 4 that is connected to a transformer 5. The converter 4 is also connected to a power supply 6, such as a mains electricity supply for delivery of about 230V alternating current (AC) at 50 or 60 Hz, a 12V direct current (DC) car battery, or a 24V or 48V DC battery. The transformer 5 comprises a primary winding 7 that is coupled to a secondary winding 8 via a transformer core 9. The secondary winding 9 is connected to a first electrode of the discharge cell via a first cable 10, and to a second electrode of the discharge cell via a second cable 11.

During operation, the converter 4 generates a direct voltage which, by means of a DC switching device in the converter 4, is rapidly applied to the primary winding 7 of the transformer 5. The application of the DC voltage to the primary winding 7 generates a magnetic field that excites the secondary winding 8 of the transformer. By rapidly switching on and off the DC voltage applied to the primary winding at a driving frequency, $f_0$, of the electric discharge device, a high voltage causing one or both of the first and second electrodes to discharge electricity through the discharge cell is applied between the first and second electrodes of the discharge cell. As well known in the art and discussed in e.g. US2002/0058000, the driving frequency, $f_0$, of the DC voltage applied to the primary winding 7 of the transformer 5 should be adapted to a resonant frequency of the cell circuit constituted by the secondary winding 8 of the transformer 9 and the discharge cell 2. For efficient operation of the electric discharge device, the driving frequency may, e.g., be set approximately equal to the resonant frequency of the cell circuit, or approximately equal to half the resonant frequency. The resonant frequency depends mainly on the inductance of the secondary winding 8 of the transformer 8 and the capacitance of the discharge cell 2. The capacitance of the discharge cell 2 in turn depends on e.g. the material and thickness of the insulating material between the electrodes, which, during operation of the electric discharge device, includes the fluid to be restructured.

In order for the electric discharge device 1 to be efficiently used with different fluids, including both gases and liquids, the drive circuit 3 may comprise a frequency modulator 12 for adapting the driving frequency of the DC voltage applied to the primary winding 7 to the fluid to be restructured. As understood from above, this involves adaption of the driving frequency, $f_0$, to the resonant frequency of the cell circuit, which depends on the type of fluid to be restructured by the discharge cell. The frequency modulator 12 may be configured to automatically determine a driving frequency based on information related to the fluid to be restructured, which information may be manually input to the electric discharge device 1 via a user interface (not shown) of the device, or obtained and communicated to the frequency modulator by one or more fluid analysers (not shown). Alternatively, the frequency modulator 12 may be a manual actuator allowing the user to manually set the driving frequency of the electric discharge device 1. Typically, the driving frequency, $f_0$, is within the range of 0.1 kHz-50 kHz, depending on the characteristic of the discharge cell 2 and the fluid to be restructured. In some embodiments, the electric discharge device 1 may be adapted for driving frequencies in the range of 100-1000 Hz. In other embodiments the electric discharge device 1 may be adapted for high-frequency operation using a driving frequency of 1000 Hz, or more. The electrode potential, i.e. the potential between the first and the second electrodes of the discharge cell 2, is typically within the range of 5 kV-25 kV, and preferably within the range of 7-12 kV.

Figure 2:
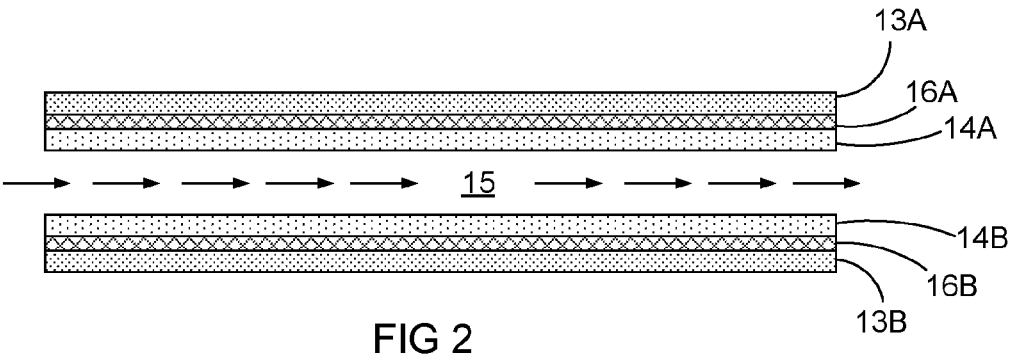
FIG. 2 illustrates schematically an exemplary embodiment of a discharge cell of the electric discharge device.

FIG. 2 illustrates schematically a discharge cell 2 of the electric discharge device 1 of the present disclosure.

The discharge cell 2 comprises a first electrode 13A and a second electrode 13B arranged on a distance from each other and connected to the transformer 5 of the drive circuit 3 in order for a potential difference to be generated between the electrodes. Two spaced-apart dielectric layers 14A and 14B are interposed between the first and the second electrodes. The dielectric layers 14A and 14B define a flow channel 15 through the discharge cell 2 for the fluid to be restructured. The dielectric layers separate the fluid in the flow channel 15 from the first and second electrodes 13A and 13B. The first dielectric layer 14A is arranged against or proximate to the first electrode 13A, and the second dielectric layer 14B is arranged against or proximate to the second electrode 13B. Besides separating the fluid to be restructured from the electrodes 13A, 13B, the dielectric layers 14A and 14B serve to diffuse electric discharge from one or both of the first and second electrodes 13A, 13B over the area of the discharge cell so as to create substantially uniform corona discharge within the flow channel 15. The electrodes 13A and 13B may be any type of electrodes known in the art for generation of corona discharge and be realized in different sizes, shapes and materials. The dielectric layers 14A and 14B may be formed by any known insulating material, such as glass, ceramic, quartz or mica.

Also shown in FIG. 2 are optional catalyser layers 16A and 16B. In some applications, in particular when the electric discharge device 1 is used for molecular restructuring of liquids, a metallic catalyser layer comprising cadmium and/or nickel, arranged between one or both electrodes and a neighbouring dielectric layer, has been found to improve the efficiency of the electric discharge device 1 in terms of its cracking ability. In particular, a cadmium-containing catalyser layer has been found advantageous in applications where the electric discharge device 1 is used for generation or refinement of fuel. Such an optional catalyser layer 16A, 16B may be arranged between one or both of the first electrode 13A and the first dielectric layer 14A, and the second electrode 13B and the second dielectric layer 14B.

As illustrated in FIG. 1, the discharge cell 2 of the electric discharge device 1 may be shaped as a tube, and preferably a cylindrical tube. An exemplary embodiment of a cylindrical discharge cell will now be described with reference to FIGS. 3A-E.

Figure 3A:
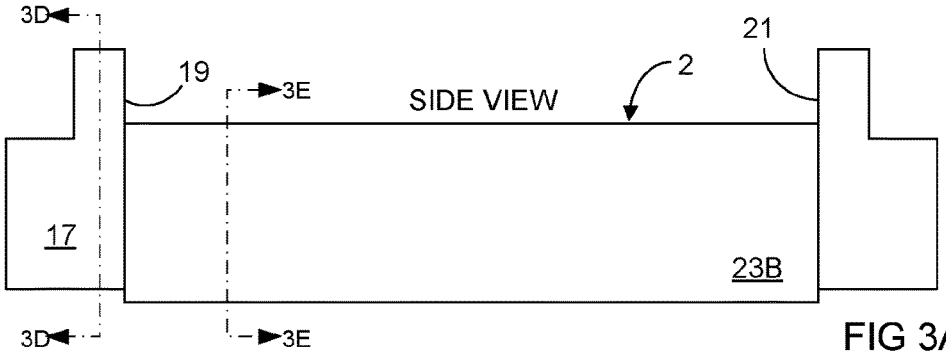
FIGS. 3A-3E illustrate a side view, a top view and cross-sectional views of a discharge cell according to an exemplary embodiment.
Figure 3B:
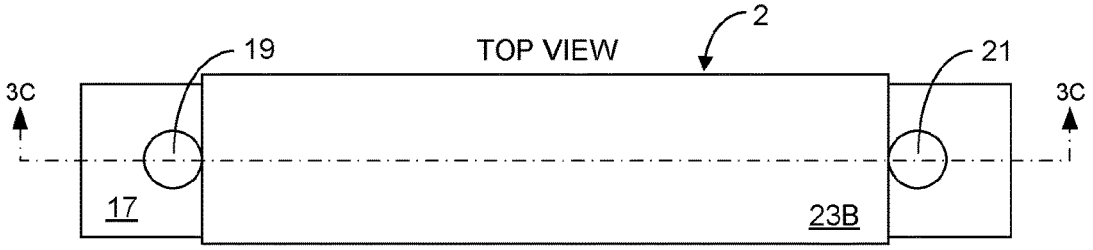
Figure 3C:
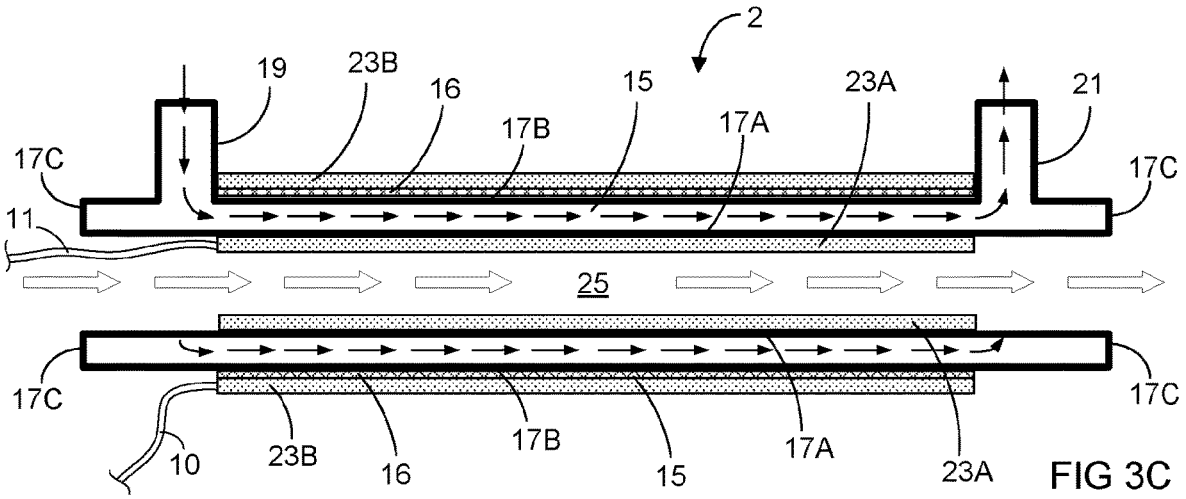
Figure 3D:
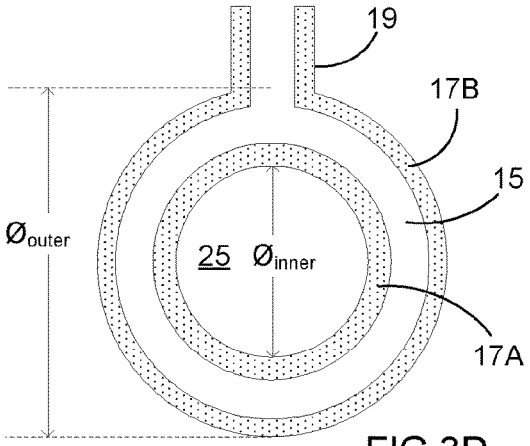
Figure 3E:
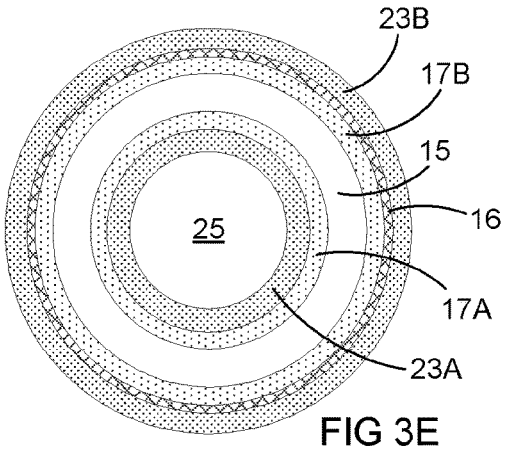

FIGS. 3A and 3B illustrate a side view and a top view, respectively, of a cylindrical discharge cell 2. FIGS. 3C-3E are cross-sectional views of the discharge cell 2 taken along the lines 3C-3C, 3D-3D and 3E-3E, respectively, in FIGS. 3A and 3B.

As best seen in FIGS. 3C and 3D, the discharge cell 2 comprises a single-piece, double-walled dielectric cylinder 17 having a cylindrical inner wall 17A and a cylindrical outer wall 17B, corresponding to the respective first and second dielectric layers 14A and 14B in FIG. 2. The inner and outer walls 17A, 17B are formed as inner and outer concentrically arranged dielectric cylinders which come together at both ends to form a hollow cylindrical shell that is closed in both ends by side walls 17C. The double-walled dielectric cylinder 17 is moulded in one piece from a dielectric material. Preferably, the dielectric material is a heat-resistant and non-brittle glass, such as borosilicate glass.

The annular space between the inner wall 17A and the outer wall 17B of the double-walled dielectric cylinder forms a flow channel 15 for the fluid to be reconstructed. The double-walled cylinder 17 comprises at least one inlet 19 for feeding fluid to be restructured into the annular flow channel, and at least one outlet 21 for discharge of fluid that has been restructured. In this exemplary embodiment, the inlet 19 and outlet 21 are formed on the envelope surface of the double-walled cylinder 17, i.e. in the outer cylindrical wall 17B thereof, in opposite ends of the double-walled dielectric cylinder 17. The inlet 19 and outlet 21 are provided with a respective connection nipple protruding from the outer cylindrical wall 17B. The inlet nipple is configured for connection to a hose or a matching connector of a device for feeding fluid to be molecularly restructured into the discharge cell 2, and the outlet nipple is configured for connection to a hose or a matching connector of a device for conveying cracked fluid away from the discharge cell 2. In FIG. 3C, flow through the discharge cell 2 of the fluid to be restructured has been indicated by black arrows.

As best seen in FIGS. 3C and 3E, an inner electrode 23A, corresponding to the first electrode 13A in FIG. 2, is arranged around the inside of the double-walled cylinder 17, inside of the inner wall 17A, and an outer electrode 23B, corresponding to the second electrode 13B in FIG. 2, is arranged around the outside of the double-walled cylinder 17, outside of the outer wall 17B. As indicated in FIG. 1, both the inner electrode 23A and the outer electrode 23B are coupled to the transformer 5 for generating a high voltage between the electrodes.

In this exemplary embodiment, both the inner electrode 23A and the outer electrode 23B are constituted by metal foils, such as stainless steel foils. The electrodes are cylindrically shaped and concentrically arranged with respect to each other and the double-walled dielectric cylinder 17. Between the inlet 19 and the outlet 21, the inner electrode 23A substantially covers the inner surface of the inner wall 17A, and the outer electrode 23B substantially covers the outer surface of the outer wall 17B. In accordance with the discharge cell illustrated in FIG. 2, the discharge cell 2 further comprises a cadmium and/or nickel containing catalyser layer 16. In this embodiment, the catalyser layer 16 is arranged between the outer electrode 23B and the outer wall 17B of the double-walled dielectric tube 17.

A through channel 25 extending in the axial direction of the double-walled dielectric cylinder 17, from one end to the other, is provided inside of the inner wall 17A. The configuration of the double-walled dielectric cylinder 17 thus allows for a cooling medium, such as air, to pass through the interior of the discharge cell 2, along the centre axis thereof, as illustrated by white arrows in FIG. 3C. In order for the cooling medium to flow freely through the through channel 25, the discharge cell 2 is preferably mounted in the electric discharge device 2 without the use of end-caps or any other component covering any of the opposed openings of the through channel 25.

For example, the discharge cell 2 may be mounted in a stand (not shown) that securely attaches the discharge cell 2 to a base plate, a wall plate or another fixed component of the electric discharge device 1. With reference to FIG. 3A, such a stand could, for example, comprise two support elements that, in one end, are securely fixed to a base plate or the like, and, in the other end, are securely fixed to the double-walled dielectric cylinder 17, at or close to a respective end thereof. For example, the tube-facing ends of the support elements could be attached by means of adhesive to the outer surface of the outer wall 17B not covered by the outer electrode 23B. In this exemplary scenario, the double-walled dielectric cylinder 17 could thus be attached to a stand for fixating the discharge cell 2 in the electric discharge device 1 by the outer (envelope) surface of the double-wall dielectric tube 17 being adhered to support elements of the stand, near the respective ends of the double-walled cylinder 17.

The electric discharge device 1 may be configured for either active or passive cooling. With reference again made to FIG. 1, the electric discharge device 1 may for example comprise a cooling device 27 for directing a flow of cooling medium towards the discharge cell 2. Preferably, the cooling device 27 is configured to direct the flow of cooling medium towards an end of the discharge cell 2, such that the cooling medium flows into the through channel 25 to cool the interior of the discharge cell 2 and, in particular, the inner electrode 23A. The cooling device 27 is preferably configured both to generate the flow of cooling medium and to direct the flow towards an end of the discharge cell 2. In the embodiment illustrated in FIG. 1, the cooling device 27 is a fan or blower for generating a flow of air, acting as cooling medium.

The dimensions of the double-walled dielectric tube 17 and the other components of the discharge cell 2 may differ substantially depending on the intended use of the electric discharge device 1.

In an exemplary embodiment where the electric discharge device 1 is particularly intended for ozone generation from an oxygen-containing feed gas, but may be used for molecular restructuring of any fluid, including liquids, the electric discharge device 1 is devised and configured in accordance with the below specification. In this embodiment, the discharge cell 2 is configured in accordance with the discharge cell illustrated in FIGS. 3A-3E, except for the illustrated discharge cell being provided with a catalyser layer 16 and not being drawn to scale.

Double-Walled Dielectric Tube
Dielectric material: Glass (borosilicate)
Length: 153 mm
Outer tube diameter ($Ø_{outer}$): 43 mm
Inner tube diameter ($Ø_{inner}$): 34 mm
Inner wall thickness: 3 mm
Outer wall thickness: 3 mm
Flow channel width: 3 mm
Inlet/outlet inner diameter: 3 mm
Inlet/outlet outer diameter: 9 mm
Other Specifications
Inner electrode: Cylindrical stainless steel foil
Outer electrode: Cylindrical stainless steel foil
Driving frequency ($f_0$): ~2.4 kHZ
Electrode potential: ~8.5 kV
Use of catalyser layer: No
Catalyser material: —
Catalyser layer thickness: —
Cooling: Active or passive air cooling
Power supply: ~230V, 50 or 60 Hz As mentioned above, an electric discharge device that is devised and configured in accordance with the above specification may be used for molecular restructuring of both gases and liquids. However, to further optimize the electric discharge device for use with liquids, the driving frequency, $f_0$, typically needs to be adjusted due to the change in resonant frequency of the cell circuit, occasioned by the relatively high viscosity and different molecular composition of the liquid compared to the oxygen-containing gas used for ozone production. Also, when otherwise configured in accordance with the above specification, the discharge cell 2 is advantageously provided with a cadmium and/or nickel-containing catalyser layer interposed between the outer electrode 23B and the outer wall 17B of the dielectric tube 17, and/or the inner electrode 23A and the inner wall 17A of the dielectric tube 17, in order to optimize the electric discharge device 1 for use with liquids.

Figure 4A:
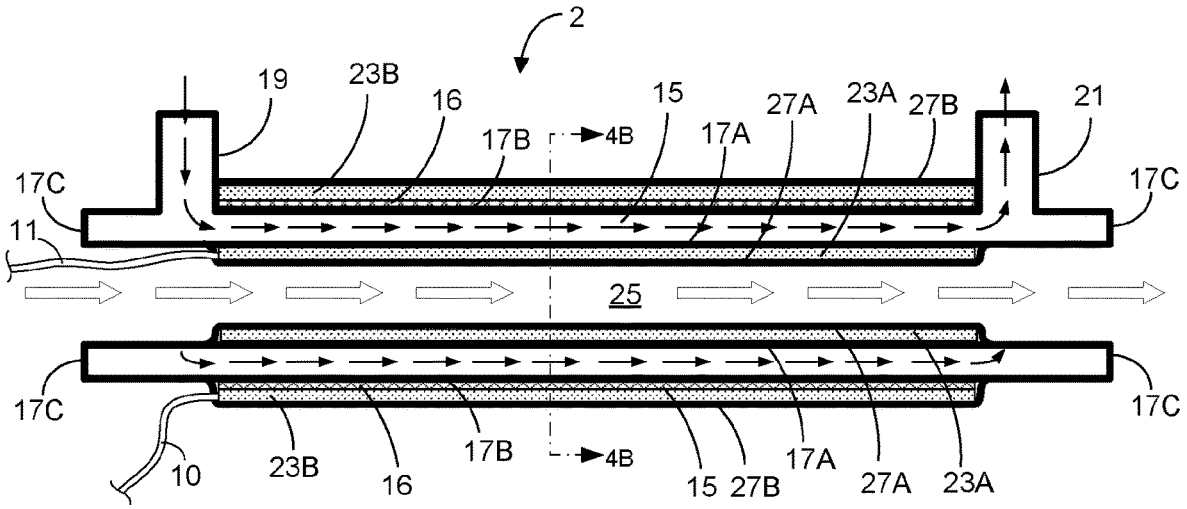
FIGS. 4A-4B illustrate cross-sectional views of a discharge cell according to another exemplary embodiment.

FIG. 4A illustrates a discharge cell 2 according to another embodiment of the present disclosure. The discharge cell 2 is identical with the discharge cell of FIGS. 3A-3E except that the discharge cell comprises electrode-covering dielectric layers 27A, 27B that cover the inner and outer electrodes 23A, 23B and prevent them from getting into contact with ambient air and the cooling medium passing through the through channel 25 of the double-walled dielectric tube 17. This has the effect of preventing moisture and dust in the ambient air and/or the cooling medium to corrode or otherwise adversely affect the function of the electrodes.

The electrode-covering layers 27A, 27B may be made of any dielectric material but is preferably made of the same dielectric material as the double-walled dielectric cylinder 17. Consequently, in one exemplary embodiment, both the inner and outer walls 17A, 17B of the double-walled dielectric cylinder 17 and the electrode-covering layers 27A, 27B are made of glass, such as borosilicate glass. Preferably, the electrode-covering layers 27A, 27B forms an integral part of the double-walled dielectric cylinder 17 and serves to retain the inner and outer electrodes 23A, 23B against the inner surface of the inner wall 17A and the outer surface of the outer wall 17B, respectively. In other words, the inner electrode 23A is sealed within an inner wall of the dielectric tube 17, formed by the inner wall 17A and the inner electrode-covering layer 27A, and the outer electrode 23B is sealed within an outer wall of the dielectric tube 17, formed by the outer wall 17B and the outer electrode-covering layer 27B. In this way, the entire discharge cell 2, including the dielectric layers, electrodes and any optional catalyser layer, may be formed as a single, integral part.

An exemplary method for manufacturing the discharge cell 2 may comprise the steps of moulding the double-walled dielectric cylinder 17 in one-piece, positioning a cylindrical inner electrode 23A against or proximate to the inner surface of the inner wall 17A, along a portion of the axial extension of the dielectric tube 17, positioning a cylindrical outer electrode 23B against or proximate to the outer surface of the outer wall 17B of the dielectric tube 17, along an axial extension of the dielectric tube 17 overlapping the axial extension of the inner electrode 23A, and applying electrode-covering dielectric layers 27A, 27B onto the surfaces of the inner and outer electrodes 23A, 23B not facing the double-walled dielectric tube 17. The electrode-covering layers 27A, 27B may have adhesive properties and be applied such that they adhere to the inner surface of the inner wall 17A and the outer surface of the outer wall 17B in the respective axial ends of the electrodes 23A, 23B, thereby retaining the electrodes in fixed spatial relationship with the dielectric tube 17 while preventing the electrodes from getting into physical contact with the cooling medium and/or ambient air. Cables or cable connectors may be connected to the electrodes prior to application of the electrode-covering dielectric 27A, 27B to render possible subsequent connection of the inner and outer electrodes 23A, 23B to the transformer 5 of the electric discharge device 1, via the first and second cables 10, 11 illustrated in FIG. 1.

Figure 4B:
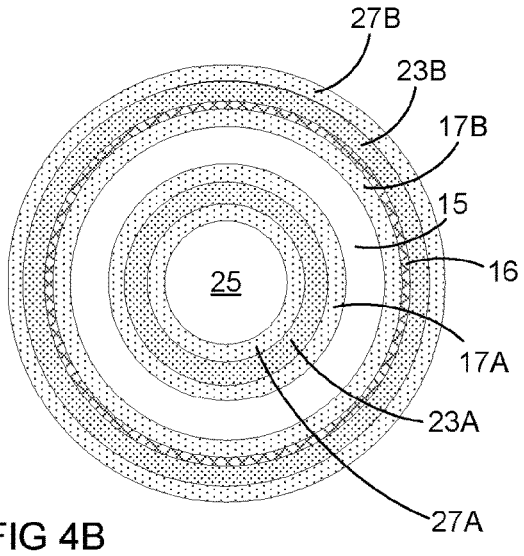

As best shown in FIG. 4B, illustrating a cross-sectional view of the discharge cell 2 in FIG. 4A, taken along the line 4B-4B, the electrode-covering layers 27A, 27B constitute an innermost dielectric cylinder and an outermost dielectric cylinder of the discharge cell 2. Consequently, in this embodiment, the dielectric cylinder 17 actually constitutes a four-walled dielectric cylinder comprising four concentrically arranged cylindrical walls of different diameters, at least along the axial extensions of the electrodes 23A, 23B. In the order of increasing diameter, the inner electrode 23A is arranged between a first and a second dielectric cylinder, formed by the inner electrode-covering dielectric layer 27A and the inner wall 17A of the double-walled dielectric cylinder 17, the annular flow channel 15 for the fluid to be reconstructed is arranged between the second and third dielectric cylinder, formed by the respective inner and outer walls 17A and 17B of the double-walled dielectric cylinder 17, and the outer electrode 23B is arranged between the third and the fourth dielectric cylinder, formed by the outer wall 17B of the double-walled dielectric cylinder 17 and the outer electrode-covering dielectric layer 27B.

Figure 5:
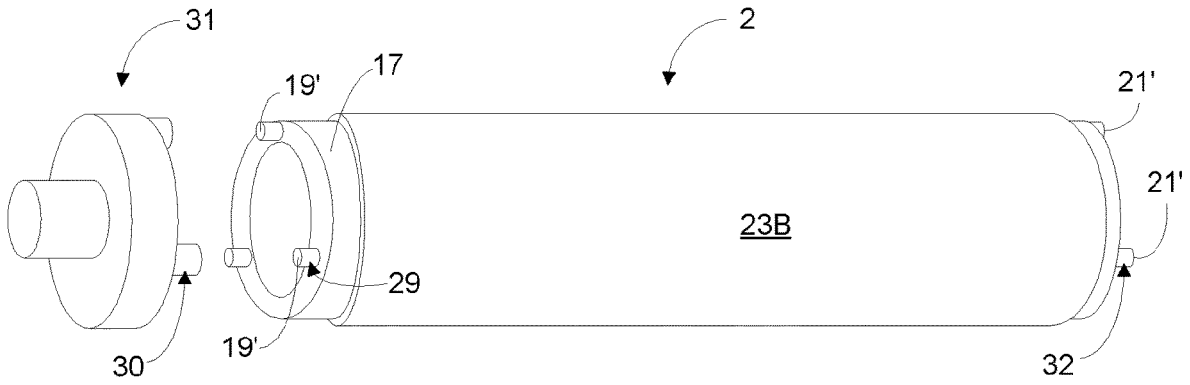
FIG. 5 illustrates a perspective view of a discharge cell according to yet another embodiment.

FIG. 5 illustrates a discharge cell 2 according to yet another embodiment of the present disclosure. In this embodiment, the inlet and outlet for the feed fluid are not located on the envelope surface of the double-walled dielectric tube 17. Instead, the discharge cell 2 comprises at least one inlet 19' for the feed fluid arranged on a side wall 17C of the double-walled dielectric tube, i.e. an inlet 19' that is formed in the wall part that is substantially perpendicular to the longitudinal extension of the double-walled dielectric tube 17 and connects the inner wall 17A with the outer wall 17B. The at least one inlet 19' may comprise a plurality of apertures formed in the side wall 17C. Likewise, at least one outlet 21' of the flow channel 15 is constituted by a plurality of apertures formed in the side wall 17C of the opposite end of the double-walled dielectric tube 17. Each inlet 19' may be provided with a connector 29 for connection to a hose or a matching connector 30 of a device 31 for feeding fluid to be restructured into the discharge cell 2. Likewise, each outlet 21' may be provided with a connector 32 for connection to a hose or a matching connector of a device (not shown) for conveying the cracked fluid away from the discharge cell 2. The connectors 29, 32 may be provided in form of connection nipples protruding from the end walls 17C of the double-walled tube 17 and surrounding the apertures constituting inlets and outlets of the discharge cell 2.

With simultaneous reference to previous drawings, methods for molecular restructuring of fluids according to various embodiments of the present disclosure will now be described with reference to FIGS. 6-9. The methods are performed using the electric discharge device 1 as illustrated in FIG. 1, equipped with a discharge cell 2 as illustrated in any of the FIGS. 2-5, and preferably a discharge cell 2 as illustrated in any of the FIGS. 3-5.

Figure 6:
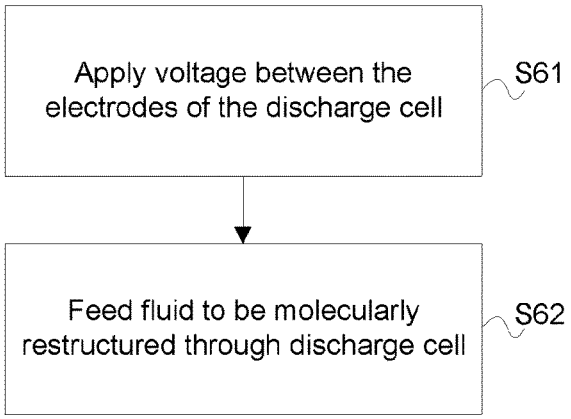
FIG. 6 is a flowchart illustrating a method for molecular restructuring of a fluid, according to an exemplary embodiment of the present disclosure.

FIG. 6 illustrates a general method for molecular restructuring of a fluid.

In a first step, S61, a voltage is applied between the electrodes of the discharge cell to generate corona discharge in the flow channel within the discharge cell, as described above with reference to FIG. 1. The flow channel is formed by two spaced-apart dielectric layers arranged between the electrodes, which dielectric layers prevent the fluid from getting into physical contact with the electrodes of the discharge cell.

In a second step, S62, a feed fluid to be molecularly restructured is fed into the flow channel and subjected to the corona discharge. As a result, the feed fluid is cracked into a cracked fluid having another molecular composition than the feed fluid. That the feed fluid is cracked means that at least some of the molecules of the feed fluid are cracked into lighter molecules which may or may not combine into other molecules, thereby producing a cracked fluid that comprises molecules not found in the feed fluid. The cracked fluid is then discharged from the discharge cell, typically for subsequent use in another physical or chemical process, such as a process for purification of wastewater or combustion of the cracked fluid for propulsion of a vehicle.

The feed fluid may, for example, be an oxygen-containing gas that is fed through the discharge cell to produce ozone. The ozone may then be used in a wide variety of applications, for example for purification of contaminated water, including both drinking water and wastewater. In other embodiments, the feed fluid is a liquid that is cracked by the electric discharge device for the purpose of purifying, refining and/or activating the liquid prior to subsequent use of the cracked liquid in other physical or chemical processes. In other embodiments, the feed fluid may be a fuel that is refined into a more reactive fuel by the cracking process prior to combustion of the fuel in a combustion engine. The method may also be employed to produce biofuel from vegetable oils, such as jatropha oil, palm oil or rape seed oil.

Figure 7A:
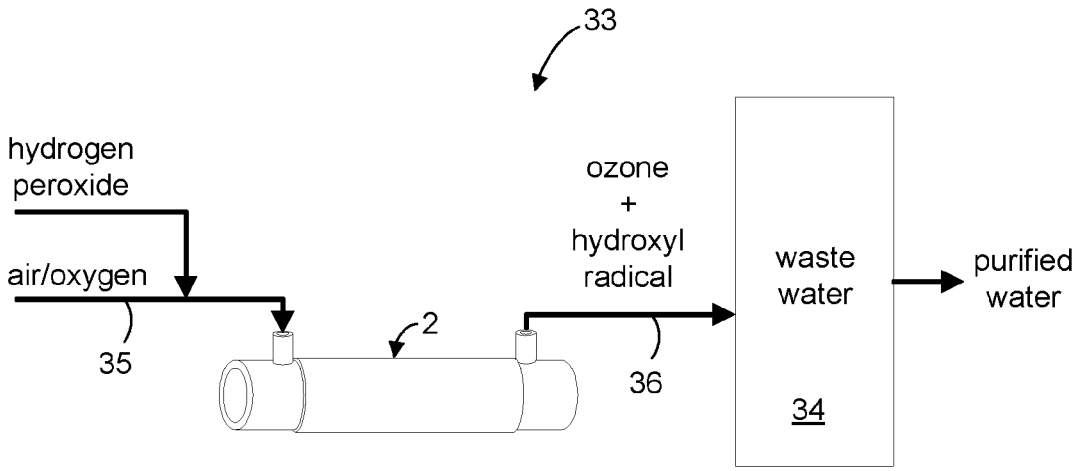
FIGS. 7A and 7B illustrate a system and method for wastewater purification, according to exemplary embodiments of the present disclosure.
Figure 7B:
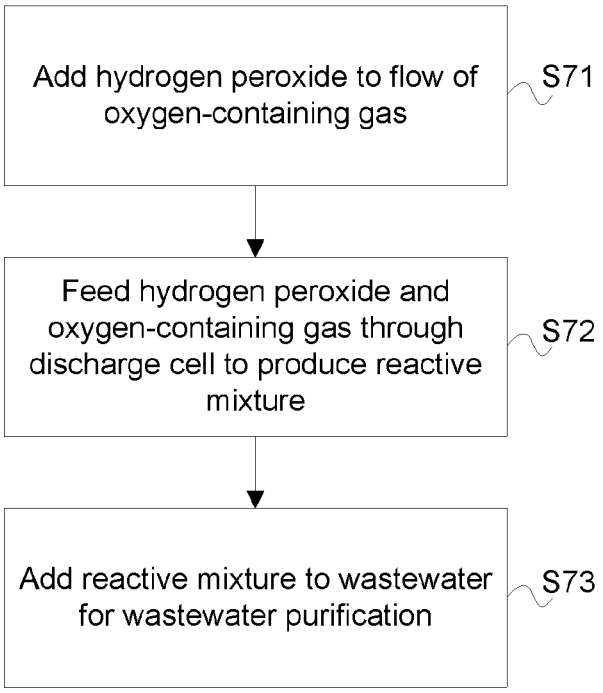

FIGS. 7A and 7B illustrate a system 33 and method for wastewater purification according to an exemplary embodiment of the present disclosure. The method is based on the known principle of generating ozone by conducting oxygen-containing gas, such as air or oxygen, through a discharge cell of an electric discharge device, and adding the ozone to a wastewater reservoir 34 for purification of wastewater. The discharge cell is the discharge cell 2 described above with reference to any of FIGS. 2-5, forming part of an electric discharge device 1 as described with reference to FIG. 1. For the sake of simplicity, only the discharge cell 2 of the electric discharge device 1 is shown in the drawing.

In the proposed method, hydrogen peroxide is added to the flow of oxygen-containing gas (step S71), upstream of the discharge cell 2. For example, the hydrogen peroxide may be injected into a feed conduit 35 for the oxygen-containing gas, which feed conduit 35 is connected to the inlet 19 of the discharge cell 2. The mixture of oxygen-containing gas and hydrogen peroxide is fed into the discharge cell 2 and subjected to the corona discharge (step S72), whereby a reactive mixture comprising ozone and hydroxyl radicals is produced. The reactive mixture is then fed to the wastewater reservoir 34 via a reactive mixture feed line 36 connected to the outlet 21 of the discharge cell 2, and added to the wastewater (step S73).

As well-known in the art, the hydroxyl radical that is produced from hydrogen peroxide by the discharge cell 2 is highly reactive and reacts with many pollutants and, in particular, many volatile organic compounds. The pollutants are typically decomposed by the hydroxyl radical by removal of a hydrogen atom from the pollutant, forming water and an alkyl radical. The combination of the hydroxyl radicals and the ozone produced by the discharge cell 2 from the oxygen-containing feed has a powerful detergent effect on the wastewater. The proposed method in which a mixture of gas (oxygen-containing gas) and liquid (hydrogen peroxide) is fed through the discharge cell 2 is rendered possible by the design of the discharge cell 2 according to the present disclosure, and, in particular, by the double-wall structure of the dielectric tube 17 that prevents moisture in the feed fluid from reacting with the electrodes of the discharge cell.

Figure 8A:
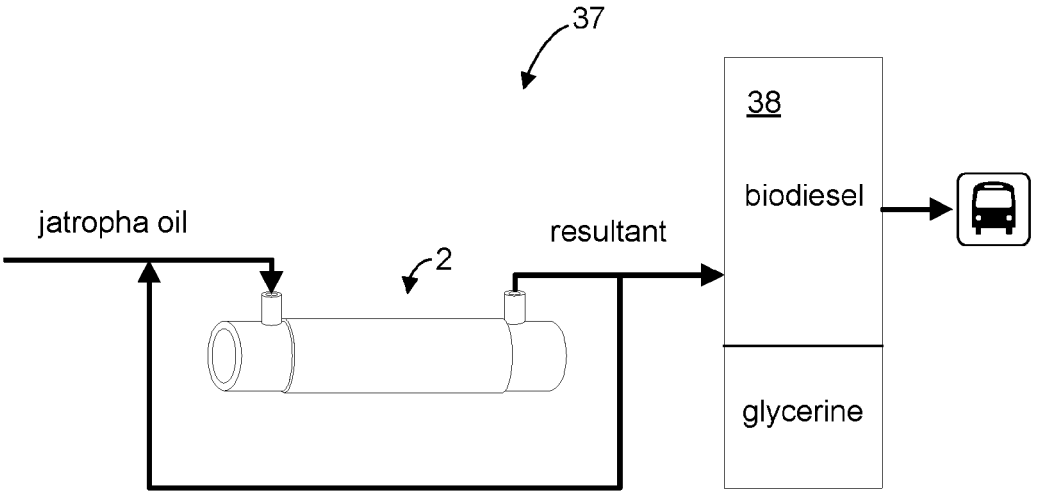
FIGS. 8A and 8B illustrate a system and method for production and/or refinement of biofuel, according to exemplary embodiments of the present disclosure.
Figure 8B:
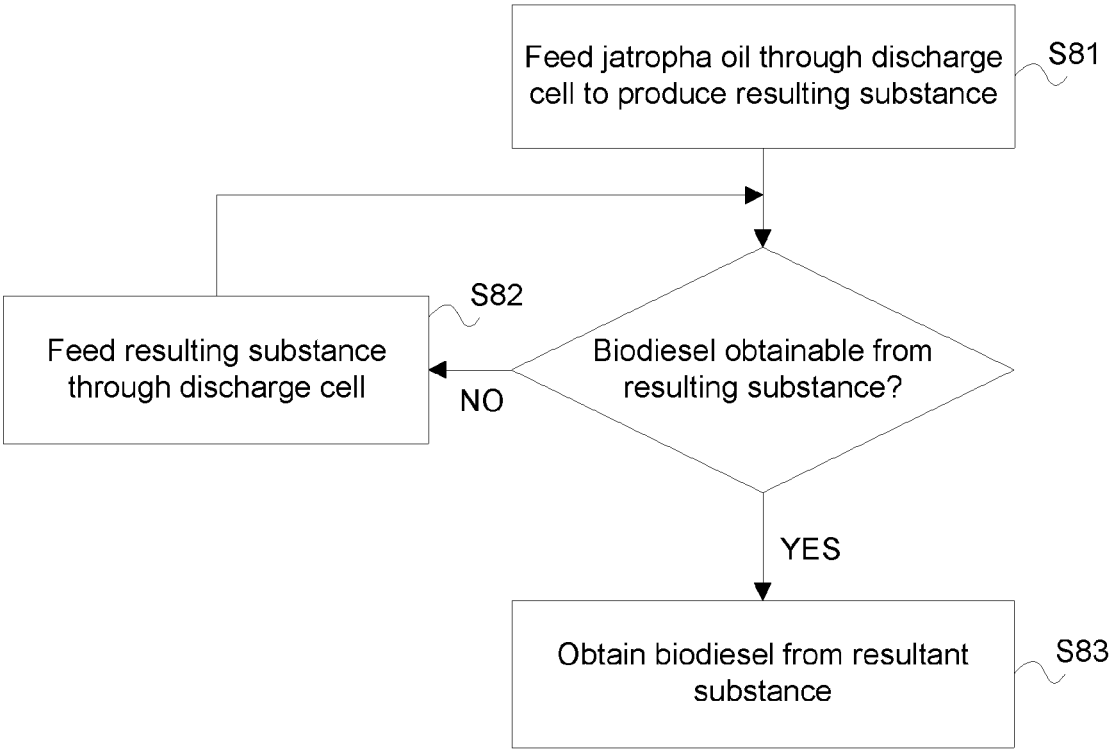

FIGS. 8A and 8B illustrate a system 37 and method for production and/or refinement of biofuel according to an exemplary embodiment of the present disclosure. More specifically, FIGS. 8A and 8B illustrate a system and method for production of biodiesel from jatropha oil, although the method is applicable also to other vegetable oils, such as palm oil and rape seed oil. The biodiesel that is produced through the method is particularly intended to be used for vehicles, i.e. for combustion in a biodiesel-compatible combustion engine of a vehicle.

As illustrated in FIG. 8A, jatropha oil is fed into the discharge cell 2 via a feed line connected to the inlet 19 of the discharge device. The discharge cell is the discharge cell 2 described above with reference to any of FIGS. 2-5, forming part of an electric discharge device 1 as described with reference to FIG. 1. For the sake of simplicity, only the discharge cell 2 of the electric discharge device 1 is shown in the drawing.

In the discharge cell 2, the jatropha oil passes through the flow channel 15 of the discharge cell 2 wherein the jatropha oil is subjected to corona discharge that cracks the jatropha oil into a resulting substance ("resultant") having a different molecular composition than jatropha oil. The cracking ability and, thus, the ability of the discharge cell 2 to turn the jatropha oil into useful biodiesel, depends on the intensity of the corona discharge within the discharge cell and the time during which the oil is subjected to the corona discharge. Theoretically, should the discharge cell be long enough, the fluid flow be low enough, and the intensity of the corona discharge be high enough, a single passage of jatropha oil through the discharge cell could be enough to turn the jatropha oil into biodiesel. In practice, however, it has been found difficult to obtain useful biodiesel from a single passage of jatropha oil through a single discharge cell 2. Furthermore, it has been found that continuously subjecting jatropha oil (and most other fluids) to corona discharge during too long periods of time may bring about negative effects, for example generation of undesired by-products. Therefore, the jatropha oil is preferably fed through the discharge cell 2 multiple times, or fed through a plurality of discharge cells connected in series. This will gradually turn the jatropha oil into useful biodiesel while allowing the fluid to come to rest between each passage through the corona discharge field. When the substance resulting from the multiple passages through the discharge cell(s) exhibits certain desired characteristics, or after having passed through a discharge cell 2 a predetermined number of times, the process is interrupted and biodiesel is extracted from the substance.

The above process for production of biofuel from vegetable oils, exemplified by a process for production of biodiesel from jatropha oil, is summarized in FIG. 8B.

In a first step S81, jatropha oil is fed through the discharge cell 2 to produce a resulting substance. If biodiesel is not obtainable from the resulting substance, the method proceeds to step S82, whereby the resulting substance is fed through the discharge cell again, or fed through a further discharge cell (not shown) connected in series with the illustrated discharge cell. This process is repeated until biodiesel is obtainable from the resulting substance having passed through the discharge cell(s), whereby the method proceeds to step S83 in which biodiesel is obtained from the resulting substance.

Typically, the jatropha oil should be fed through a discharge cell at least three times, more preferably in the range of four to six times, and most preferably five times. For optimal cracking of the jatropha oil, the temperature of the fluid should be maintained in the range of 30 to 45 degrees Celsius during the process, more preferably in the range of 35 to 40 degrees Celsius, and most preferably at approximately 38 degrees Celsius. Therefore, if required, the method may further comprise a step of heating the fluid prior to feeding it through the discharge cell.

Biodiesel is typically extracted from the resulting substance through a separation process in which the resulting substance is separated into a first substance which mainly comprises glycerine, and a second substance constituting a liquid which, directly or after further refinement, may be used as biodiesel.

The separation process may comprise a sedimentation process in which glycerine is suspended to settle out of the resulting substance. For example, the substance resulting from the one or more passages through the discharge cell may be collected in a reservoir 38 where it is stored for a time period allowing glycerine to settle as sediment on the bottom of the reservoir. The fluid found on top of the glycerine after the sedimentation process is biodiesel that may be used for combustion in combustion engines, or for other purposes. A passive sedimentation process caused by gravity may take approximately 3-5 days.

Figure 9A:
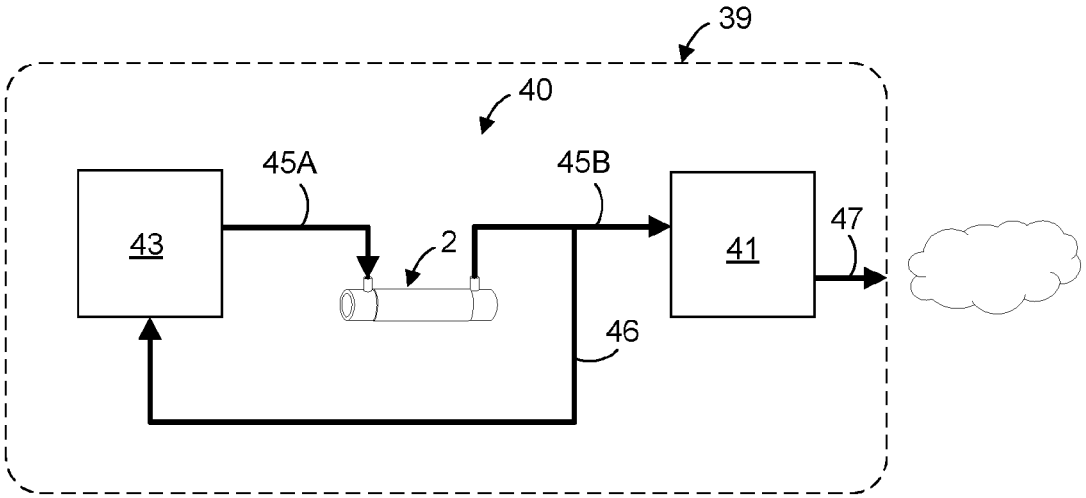
FIGS. 9A and 9B illustrate a system and method for refinement of fuel in a vehicle, prior to combustion of the fuel in a combustion engine of the vehicle, according to exemplary embodiments of the present disclosure.
Figure 9B:
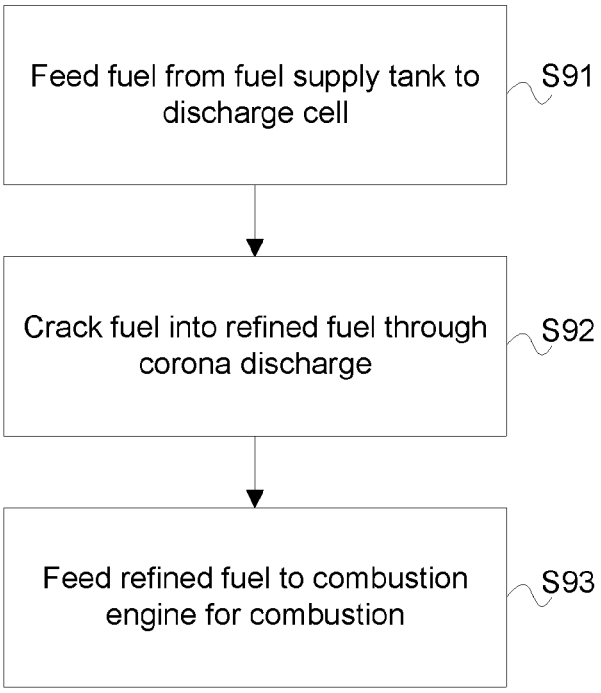

FIGS. 9A and 9B illustrate a system and method for refinement of fuel in a vehicle 39, prior to combustion of the fuel in a combustion engine 41 of the vehicle. The combustion engine is typically an internal combustion engine (ICE) and the fuel may be either a fossil fuel, such as conventional diesel, or a renewable fuel, such as biodiesel. The vehicle 39 may be any type of vehicle, e.g., a car, a bus, a truck or a ship.

The vehicle 39 comprises a fuel system, generally denoted by reference numeral 40, comprising a fuel supply tank 43 and a fuel supply line for feeding fuel from the fuel supply tank to a combustion engine 41. The vehicle further comprises an electric discharge device 1, as described above with reference to FIG. 1, including a discharge cell 2 as described in more detail with reference to any of FIGS. 2-5. For the sake of simplicity, only the discharge cell 2 of the electric discharge device 1 is shown in the drawing.

The discharge cell 2 is mounted upstream of the combustion engine 41 and forms an integral part of the fuel supply line. The fuel is fed from the fuel supply tank 43 to the discharge cell 2 via a first conduit 45A of the fuel supply line, connected to the inlet 19 of the discharge cell 2. In the discharge cell 2, the fuel is fed through the flow channel 15 in which it is subjected to corona discharge that is adapted to crack the fuel molecules to produce a refined fuel having a different and more combustion-efficient molecular composition. It should be noted that the discharge cell 2 is not mounted around a fuel supply conduit through which the fuel passes but constitutes an integrated part of the fuel supply line in the meaning of the dielectric layers of the discharge cell constituting the walls of the fuel supply line. Also, it should be emphasized that the discharge cell 2 is configured to change the molecular composition of the fuel by subjecting the fuel to a corona discharge having an intensity that effectively cracks the molecules of the fuel. This is in contrast to prior art solutions in which the fuel is subjected to an electromagnetic field that only serves to electrically charge the fuel for improved combustion thereof in the combustion engine.

After passage through the flow channel 15 of the discharge cell, the refined fuel is fed to the combustion engine via a second conduit 45B of the fuel supply line, connected to the outlet 21 of the discharge cell. In the combustion engine 41, the cracked fuel is mixed with an oxidizer (usually air) for combustion of the fuel-oxygen mixture in a combustion chamber of the engine 41. Exhaust gas resulting from the combustion is discharged into atmosphere through an exhaust line 47, such as an exhaust pipe of the vehicle 39. Besides increased combustion efficiency, the cracking of the fuel prior to combustion tends to reduce noxious gas in the exhaust gas.

In some embodiments, the fuel system may further comprise a fuel return line 46 for returning some of the cracked fuel that has passed through the discharge cell 2 to a volume of the fuel system 40 that is located upstream of the discharge cell 2. This is advantageous in that the fuel can be made to pass through the discharge cell 2 multiple times prior to combustion thereof in the combustion engine 41, thereby further increasing the combustion efficiency and reducing noxious gas in the exhaust gas. In the illustrated embodiment, the fuel return line 46 is configured to return some of the fuel that has passed through the discharge cell 2 to the fuel supply tank 43. This has the further effect of allowing the cracked fuel to come to rest before again being subjected to the corona discharge field in the discharge cell 2.

It should be noted that many components typically forming part of the fuel system in FIG. 9A have been left out of the drawing in order not to obscure the drawing with unnecessary detail. For example, the fuel system may include one or more fuel pumps, injection pumps, fuel filters, pressure gauges, injection nozzle, or any other component typically found in a conventional vehicle fuel system.

The method for refinement of fuel in a vehicle, prior to combustion of the fuel in a combustion engine of the vehicle, is summarized in FIG. 9B.

In a first step, S91, fuel is fed from the fuel supply tank 43 to the discharge device 2. In a second step, S92, the fuel is subjected to corona discharge within the discharge cell 2 and is cracked into a refined and more combustion-efficient fuel. In a third step S93, the refined fuel is fed to the combustion engine 43 for combustion within a combustion chamber. As discussed above, the method may further comprise a step of feeding some of the refined fuel through the discharge cell at least a second time, prior to feeding the refined fuel to the combustion engine, in order to further increase combustion efficiency.

Figure 10A:
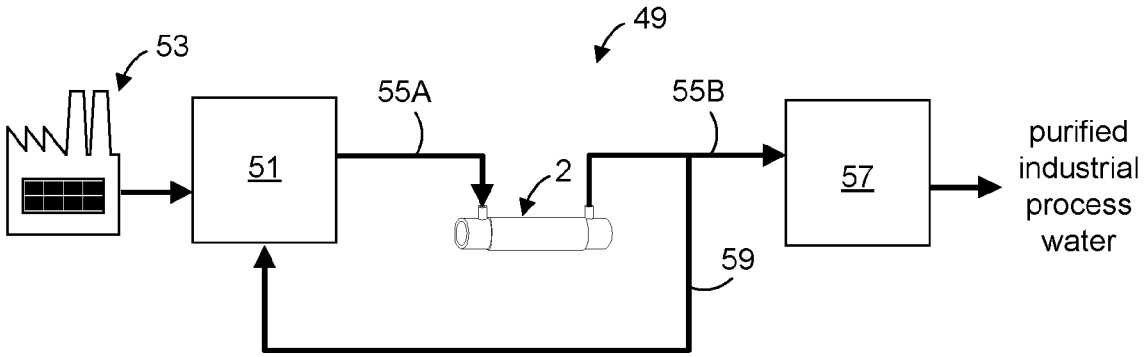
FIGS. 10A and 10B illustrate a system and method for treatment of industrial process water, according to exemplary embodiments of the present disclosure.
Figure 10B:
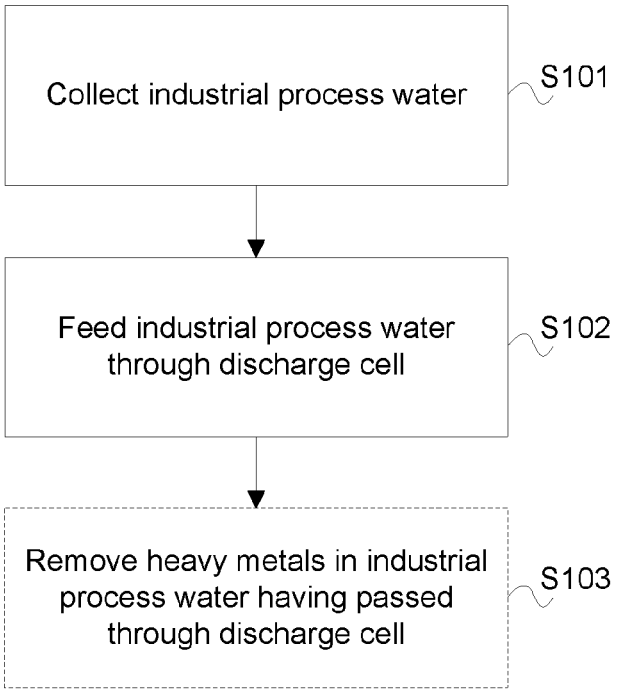

FIGS. 10A and 10B illustrate a system 49 and method for treatment of industrial process water, i.e. industrial wastewater that is produced as a by-product of industrial or commercial activities.

The system 49 in FIG. 10A comprises a reservoir 51 for collection of industrial process water comprising chemical waste components from an industrial process taking place at an industrial site, for example in a factory 53. The system further comprises an electric discharge device 1, as described above with reference to FIG. 1, including a discharge cell 2 as described in more detail with reference to any of FIGS. 2-5. For the sake of simplicity, only the discharge cell 2 of the electric discharge device 1 is shown in the drawing. A feed line 55A is connected between the reservoir 51 and the inlet 19 of the discharge cell 2 for feeding the collected industrial process water into the discharge cell 2. The industrial process water then passes through the flow channel 15 of the discharge cell 2, wherein it is subjected to the corona discharge field between the electrodes of the discharge cell, which corona discharge field effectively cracks at least some of the chemical waste components in the industrial process water into constituents that are less hazardous or harmful to the environment. After passage through the discharge cell 2, the so treated industrial process water is discharged from the discharge cell 2 via a line 55B for treated industrial process water, connected to the outlet 21 of the discharge cell 2. In some embodiments, the line 55B for treated industrial process water may be connected to a subsystem 57 for subsequent treatment of the cracked chemical waste components in the industrial process water. Although not shown in the drawing, the system 49 may also comprise one or several subsystems for pretreatment of the industrial process water, arranged upstream of the discharge cell 2. The system 49 may further comprise a return line 59 for returning some or all of the treated industrial process water that has passed through the discharge cell 2 to the reservoir 51, or any other volume that is located upstream of the discharge cell 2. This is advantageous in situations in which the industrial process water should be made to pass through the discharge cell 2 multiple times for optimal treatment thereof.

Passing the industrial process water through the discharge cell 2 has the effect of producing oxidizing agents in the industrial process water. It also has the effect of cracking toxic chemical components into lighter, more reactive and more disintegrable or decomposable components. The cracked chemical components may be disintegrated by the oxidizing agents thus formed in the industrial process water itself, or they may be disintegrated in subsequent and conventional processes for treatment of industrial process water, performed on the industrial process water by the subsystem 57, after having passed through the discharge cell 2. It has been found that the cracking by the discharge cell 2 of the chemical components of the industrial process water facilitates disintegration of the chemical components in the subsequent processes. For example, it has been shown that removal of heavy metals in the industrial process water is facilitated by first having the industrial process water pass through the discharge cell 2. Conventional techniques that may be used for subsequent removal of heavy metals in the industrial process water may include, for example, chemical precipitation, flotation, adsorption, ion exchange, and electrochemical deposition. It should thus be understood that the system 49 may comprise a subsystem 57 for subsequent treatment of industrial process water having passed through the discharge cell 2, which subsystem 57 may comprise means for removal of heavy metals, including but not limited to known means for chemical precipitation, flotation, adsorption, ion exchange, and electrochemical deposition. Preferably, the subsystem 57 comprises means for precipitation of heavy metals.

The method for treatment of industrial process water is summarized in FIG. 10B.

In a first step, S101, industrial process water is collected. In a second step, S102, the industrial process water is fed through the discharge cell 2 in which it is subjected to corona discharge that serves to crack chemical components in the industrial process water into more reactive and disintegrable chemical components. As clear from above, the method may further comprise an optional and subsequent step S103 of removal of heavy metals in the industrial process water having passed through the discharge cell 2, for example through precipitation, such as chemical precipitation of heavy metals.

All of the above mentioned methods involving molecular restructuring of fluids, described with reference to FIGS. 6-10, may be performed using any discharge cell having two spaced-apart dielectric layers arranged between the electrodes, which dielectric layers prevent the fluid from getting into physical contact with the electrodes of the discharge cell. Preferably, however, the methods are performed using a discharge cell having a double-walled dielectric tube 17, as illustrated in FIGS. 3-5, whereby the fluid, may it be liquid or gas, is fed through a flow channel 15 that is delimited by the inner 17A and outer 17B walls of the double-walled dielectric tube.

The invention claimed is:

1. An electric discharge device for molecular restructuring of a fluid, comprising a discharge cell including a first dielectric layer and a second dielectric layer that are spaced apart by a gap constituting a flow channel for a feed fluid to be molecularly restructured, the dielectric layers and the flow channel are arranged between a first electrode and a second electrode for generating electric discharge in the flow channel when voltage is applied between the electrodes, wherein the discharge cell comprises a single-piece, double-walled dielectric tube having a cylindrical inner wall that constitute the first dielectric layer, a cylindrical outer wall that constitute the second dielectric layer, at least one inlet for feeding fluid to be restructured into the flow channel, and at least one outlet for discharge of restructured fluid, wherein the cylindrical inner wall and the cylindrical outer wall come together at both ends of the dielectric tube, and wherein the at least one inlet and the at least one outlet are integrally formed in the cylindrical outer wall in opposite ends of the single-piece, double-walled dielectric tube.

2. The electric discharge device according to claim 1, wherein the first electrode comprises an inner electrode arranged on an inner side of the inner wall of the double-walled dielectric tube, and the second electrode comprises an outer electrode arranged on an outer side of the outer wall of the double-walled dielectric tube.

3. The electric discharge device according to claim 2, wherein the discharge cell is provided with a through channel extending along a center axis of the double-walled dielectric tube, and mounted in the electric discharge device such that a flow of cooling medium can flow through the through channel during use of the electric discharge device to cool the inner electrode.

4. The electric discharge device according to claim 3, further comprising a cooling device that is configured to direct a flow of a cooling medium towards an end of the discharge cell in order for the cooling medium to pass through the through channel.

5. The electric discharge device according to claim 1, wherein the cylindrical inner wall and the cylindrical outer wall define an annular flow channel for the fluid to be reconstructed.

6. The electric discharge device according to claim 5, wherein the inner and outer electrodes are formed as cylindrical shells that are concentrically arranged with respect to each other and the double-walled dielectric cylinder, the inner electrode having a diameter that is smaller than the diameter of the inner cylindrical wall, and the outer electrode having a diameter that is bigger than the diameter of the outer cylindrical wall.

7. The electric discharge device according to claim 5, wherein the at least one inlet and the at least one outlet of the flow channel are arranged on an envelope surface of the double-walled dielectric cylinder.

8. The electric discharge device according to claim 5, wherein at least one of the at least one inlet the at least one outlet of the flow channel is arranged on a side wall of the double-walled dielectric cylinder, connecting the inner wall with the outer wall.

9. The electric discharge device according to claim 1, further comprising at least one metallic catalyser layer, comprising at least one of cadmium or nickel, arranged between at least one of said first and second electrodes and at least one of said first and second dielectric layers.

10. The electric discharge device according to claim 1, further comprising a frequency modulator for adapting a driving frequency of the electric discharge device to the fluid to be restructured.

11. A vehicle comprising a combustion engine, wherein that vehicle further comprises an electric discharge device according to claim 1, wherein the electric discharge device is arranged such that fuel is fed through the flow channel of the discharge cell prior to combustion of the fuel in the combustion engine.

12. A method for molecular restructuring of a fluid, wherein the steps of:

applying a voltage between the first electrode and the second electrode of the electric discharge device according claim 1, in order to generate the electric discharge in the flow channel of the discharge cell, and feeding the fluid to be restructured through the flow channel of the discharge cell.

13. The method according to claim 12, wherein the fluid to be restructured comprises oxygen-containing gas that is fed through the discharge cell to produce ozone.

14. The method according to claim 12, wherein the fluid to be restructured comprises a mixture of oxygen-containing gas and hydrogen peroxide that is fed through the discharge cell to produce a reactive mixture comprising ozone and hydroxyl radicals.

15. The method according to claim 12, wherein the fluid to be restructured comprises a vegetable oil that is fed through the flow channel of the discharge cell to produce biodiesel.

16. The method according to claim 12, wherein the fluid to be restructured is industrial process water that is fed through the flow channel of the discharge cell to purify and/or facilitate purification of the industrial process water.

17. The method according to claim 12, performed in a vehicle comprising the electric discharge device and a combustion engine, wherein the fluid to be restructured is fuel that is fed through the flow channel of the discharge cell to refine the fuel prior to combustion of the fuel by the combustion engine.

18. The method according to claim 15, wherein the vegetable oil comprises jatropha oil.

19. The method according to claim 17, wherein the fuel comprises fossil diesel or biodiesel.

20. An electric discharge device for molecular restructuring of a fluid, comprising a discharge cell including a first dielectric layer and a second dielectric layer that are spaced apart by a gap constituting a flow channel for a feed fluid to be molecularly restructured, the dielectric layers and the flow channel are arranged between a first electrode and a second electrode for generating electric discharge in the flow channel when voltage is applied between the electrodes, wherein the discharge cell comprises a single-piece, double-walled dielectric tube having a cylindrical inner wall that constitute the first dielectric layer, a cylindrical outer wall that constitute the second dielectric layer, at least one inlet for feeding fluid to be restructured into the flow channel, and at least one outlet for discharge of restructured fluid, wherein the cylindrical inner wall and the cylindrical outer wall come together at both ends of the dielectric tube by side walls of the double-walled dielectric tube, and wherein the at least one inlet and the at least one outlet are integrally formed in one of the cylindrical outer wall or the side walls, in opposite ends of the single-piece, double-walled dielectric tube.

* * * * *